United States Patent [19]

Dillon et al.

[11] Patent Number: 4,740,215

[45] Date of Patent: Apr. 26, 1988

[54] COMPOSITION FOR CETANE IMPROVEMENT OF DIESEL FUELS

[75] Inventors: Diane M. Dillon, Yorba Linda; Peter J. Jessup, Santa Ana, both of Calif.

[73] Assignee: Union Oil Company of California, Los Angeles, Calif.

[21] Appl. No.: 6,978

[22] Filed: Jan. 27, 1987

[51] Int. Cl.[4] ..... C10L 1/10

[52] U.S. Cl. ..... 44/57; 44/66

[58] Field of Search ..... 44/57, 66

[56] References Cited

U.S. PATENT DOCUMENTS

| | | | |
|---|---|---|---|
| 2,210,942 | 8/1940 | Lipkin | 44/9 |
| 2,296,558 | 9/1942 | Kokatnur | 44/57 |
| 2,310,306 | 2/1943 | Miller et al. | 44/57 |
| 2,316,012 | 4/1943 | Miller | 44/77 |
| 2,378,341 | 6/1945 | Vaughan et al. | 44/57 |
| 2,407,718 | 9/1946 | Marschner et al. | 44/77 |
| 2,523,672 | 9/1950 | Wilder | 44/57 |
| 2,567,615 | 9/1951 | Milas | 44/57 |
| 2,655,440 | 10/1953 | Barusch et al. | 44/57 |
| 2,763,537 | 9/1956 | Barusch et al. | 44/57 |
| 3,933,543 | 1/1976 | Madden | 149/114 |
| 4,473,378 | 9/1984 | Hanlon et al. | 44/57 |
| 4,494,961 | 1/1985 | Venkat et al. | 44/57 |
| 4,536,190 | 8/1985 | Seemuth | 44/57 |
| 4,549,883 | 10/1985 | Purcell et al. | 44/57 |
| 4,561,862 | 12/1985 | Dory | 44/57 |
| 4,566,878 | 1/1986 | Karol et al. | 44/57 |
| 4,568,358 | 2/1986 | Courtney | 44/57 |
| 4,575,382 | 3/1986 | Sweeney et al. | 44/77 |
| 4,604,102 | 8/1986 | Zoweski et al. | 44/57 |
| 4,644,078 | 2/1987 | Morris et al. | 558/277 |

*Primary Examiner*—William R. Dixon, Jr.
*Assistant Examiner*—Margaret B. Medley
*Attorney, Agent, or Firm*—Dean Sandford; Gregory F. Wirzbicki; G. Keith deBrucky

[57] ABSTRACT

Liquid hydrocarbon fuels, especially diesel fuels, are admixed with diesters of oxalic acid to produce liquid hydrocarbon fuel compositions having improved ignition quality and enhanced cetane numbers.

55 Claims, No Drawings

COMPOSITION FOR CETANE IMPROVEMENT OF DIESEL FUELS

BACKGROUND OF THE INVENTION

This invention relates to an organic compound additive for liquid hydrocarbon fuels and liquid hydrocarbon fuel compositions containing such additive. The additive is useful for improving the ignition quality and increasing the cetane number of liquid hydrocarbon fuels, and more particularly relates to diesel fuels with enhanced cetane numbers.

Diesel engines use the heat developed by compressing a charge of air to ignite the fuel injected into the engine cylinder after the air is compressed. More specifically, in the engine, the air is first compressed, then fuel is injected into the cylinder; as fuel contacts the heated air, it vaporizes and finally begins to burn as the self-ignition temperature is reached. Additional fuel is injected during the compression stroke and this fuel burns almost instantaneously, once the initial flame has been established.

A period of time elapses between the beginning of fuel injection and the appearance of a flame in the cylinder. This period is commonly called "ignition delay," and is a major factor in regard to the performance of a diesel fuel. If ignition delay is too long, the fuel will accumulate in the cylinder until it reaches ignition conditions and then will burn rapidly, causing a sudden pressure increase which may result in engine knocking. Too long an ignition delay may result in a smokey exhaust, a decrease in engine efficiency, and possibly dilution of the crank case oil. A reduction in ignition delay can be obtained by varying the chemical nature of the injected fuel. Straight-chain paraffinic hydrocarbons give the least ignition delay, while branched-chain paraffins and cyclic (including aromatic) hydrocarbons tend to have poorer ignition characteristics. For this reason, n-hexadecane ("cetane"), which is a diesel fuel having excellent ignition qualities, has long been used as a standard reference material for determining the ignition quality of commercial diesel fuels. A scale called "cetane number" has been devised for ranking the relative ignition delay characteristics of a given diesel fuel. The cetane number of an unknown fuel is determined by comparing its ignition delay in a standard test engine with reference fuels which are prepared by blending cetane (assigned a rating of 100) and 2,2,4,4,6,8,8-heptamethylnonane (assigned a rating of 15) until a reference fuel is found to have the same ignition delay characteristics as the unknown fuel; the cetane number is obtained by the equation:

$$\text{Cetane No.} = (\text{Vol. \% Cetane}) + [0.15\ (\text{Vol. \% Heptamethylnonane})]$$

In general, large stationary engines which run at fairly constant speeds and loads have the lowest cetane number requirements (e.g., 30 to 45), while smaller, motor vehicle diesel engines have the highest requirements (e.g., 40 to 55) for obtaining optimum performance.

One of the more important difficulties that arises through the use of diesel engines is the problem of starting the engine when it is cold. Fuels with high cetane numbers have the advantage of giving relatively easy starting at low temperatures. Additionally, fuels with high cetane numbers reduce destructive combustion knock, provide more efficient combustion and smooth engine operation, lower maximum cylinder pressures, and reduce carbon deposits on cylinder heads.

Historically, diesel engines have been operated on a petroleum-derived liquid hydrocarbon fuel boiling in the range of about 300°-750° F. (149°-399° C.) Modern petroleum refineries can produce high quality diesel fuels containing large straight-chain paraffins. However, due to competing demands for other products, limitations imposed by poor quality heavy crude oils, and other factors, refineries frequently are unable to meet the total demand for such diesel fuels. Because of these refining constraints, and dwindling petroleum reserves, alcohol-hydrocarbon blends have been studied for use as diesel fuels. The addition of alcohol to the hydrocarbon liquid tends to produce a fuel with a further reduced cetane number.

Through the years, many types of additives have been prepared to raise the cetane number of diesel fuels. Such additives usually contain nitrogen or sulfur, both of which are known cetane improvers under certain circumstances. The most popular additives, for example, appear to be hexyl or octyl nitrate. However, these additives are highly combustible, as are most of the organic nitrogen- or sulfur-containing additives commonly used. Further, the nitrogen-containing compounds can add to an engine's $NO_x$ emissions, which contribute to photochemical reactions known to cause smog formation, as well as formation of nitric acid, a factor in acid rain. The sulfur-containing compounds contribute to $SO_x$ formation which can contaminate the lube oil by forming sulfuric acid which breaks down various antiwear additives found in the oil. Also, $SO_x$ emissions contribute to the formation of particulate matter in the form of sulfates which must be emitted from the exhaust.

With the continued increase in demand for diesel fuel in both passenger cars and trucks and the economic restraints on the quality of available diesel fuel, there is a need for new, safer, and more economical cetane boosters. Accordingly, it is a feature of the present invention to provide new, safer, and more economical cetane boosters for middle distillate fuels, more particularly diesel fuel.

SUMMARY OF THE INVENTION

The present invention is directed to liquid hydrocarbon fuel compositions which have improved ignition quality and increased cetane number. Such compositions are comprised of a liquid hydrocarbon fuel and an organic compound having the following structure:

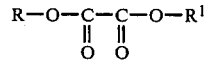

where R and $R^1$ are the same or different organic radicals. R and $R^1$ are most preferred to be the same alkyl radicals with at least 2 carbon atoms each, with particular preference being given for straight chain alkyl groups. The compositions are prepared by admixing the organic compound with the liquid hydrocarbon fuel in an amount sufficient to increase the cetane number of the fuel.

So that the above-recited features, advantages and objects of the invention, as well as others which will become apparent, are attained and can be understood in detail, a more particular description of the invention is set forth below with respect to typical embodiments thereof, but the described embodiments should not be considered limiting the scope of the invention because other, equally effective embodiments thereof will be apparent from the description to one of ordinary skill in the art.

DETAILED DESCRIPTION OF THE INVENTION

In accordance with the invention, there is provided a liquid hydrocarbon fuel composition which has improved ignition quality and increased cetane number. This composition comprises an admixture of a liquid hydrocarbon fuel and an organic compound having the following structure:

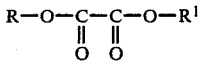

where R and $R^1$ are the same or different organic radicals. Particularly preferred is where R and $R^1$ are the same alkyl radicals with at least 2 carbon atoms each. The organic compounds of the present invention are commonly referred to as diesters of oxalic acid or oxalates.

While the invention is not bound to any particular theory, it is believed that the oxalate decomposes at low temperature in the combustion chamber to produce carbon monoxide, carbon dioxide, and organic radicals. The organic radicals are considered to be favorable ingredients for starting combustion by abstracting hydrogen atoms from the fuel molecules and initiating oxidation.

A variety of oxalates are useful in the present invention. The organic radicals found useful in oxalates of the above formula include but are not limited to alkyls, alkenyls, cycloalkenyls, and aromatics, e.g., aryl, alkylaryl, arylalkyl, alkenylaryl, arylalkenyl, etc. At least one of the organic radicals of the preferred oxalate contains two or more carbon atoms, and in the more preferred oxalate, both R and $R^1$ contain at least two carbon atoms. Generally, R and $R^1$ contain no more than fifty, and preferably no more than twenty carbon atoms. The more preferred oxalates have organic radicals which are the same or different alkyls with at least two carbon atoms each. Still more preferred is where the alkyl groups are the same, such as di-t-butyl oxalate, diethyl oxalate, and dibutyl oxalate. The most preferred contain straight chain alkyl groups, such as diethyl oxalate and dibutyl oxalate.

Generally, the liquid fuel composition is comprised of a liquid hydrocarbon fuel and a sufficient amount of one or more oxalates to improve ignition quality and increase cetane number. Preferably, the oxalate is present in dissolved form in a sufficient concentration to improve the cetane number rating by at least 1.0. Still more preferably, the oxalate is present in a concentration from about 0.1 to about 10 weight percent, and more preferably from about 1 to 5 weight percent based upon the total weight of fuel and oxalate.

The preferred liquid hydrocarbon fuels useful for preparing the liquid fuel compositions of this invention are generally classified as petroleum middle distillates boiling in the range of 350°–700° F. (177°–371° C.). The hydrocarbon stock can comprise straight run, or cracked gas oil, or a blend in any proportion of straight run or thermally and/or catalytically cracked distillates, etc. The most common petroleum middle distillate hydrocarbon stocks are kerosene, diesel fuels, aviation fuels, and heating oils. The most preferred petroleum middle distillate hydrocarbon stocks are diesel fuel.

A typical specification for a diesel fuel includes a minimum flash point of 100° F. (38° C.), a boiling point range of from about 300° F. (149° C.) to about 700° F. (371° C.) and a 90 percent distillation point (ASTM D86) between 540° F. (282° C.) and 640° F. (338° C.), i.e., 90 percent by volume boils below 640° F. (338° C.). (See ASTM D975.)

The liquid hydrocarbon fuel of the present invention may, for example, also comprise any of the known conventional additives, such as surfactants, dyes, antioxidants, pour point depressants, etc.

The following Example serves to further illustrate and instruct one skilled in the art in the best mode of practicing this invention and is not intended to be construed as limiting thereof.

EXAMPLE

Cetane tests were conducted with a No. 2 diesel fuel containing four different oxalates. The experimental procedure used to determine the fuels cetane number was the ASTM D-613 Test for the Ignition Quality of Diesel Fuels by the Cetane Method. Tests were conducted in a single-cylinder, CFR engine. Four different oxalates were each tested for cetane improving properties. Each was added to a separate sample of No. 2 diesel fuel and the ASTM cetane test conducted on the fuel samples. A sample of pure No. 2 diesel fuel was also tested and used as a baseline for determining the activity of the oxalates. The No. 2 diesel fuel has a cetane number of 47.8 and a cetane index of 46.19; a flash point of 179° F. (81° C.), a cloud point of 0° F. (−17.8° C.), and an API gravity at 60° F. (15.6° C) of 32.9. The results of said test are provided in the following Table.

TABLE

The Effects of Oxalates on Diesel Fuel Cetane Number

| Oxalate | Amount in Fuel (wt %) | Change in Cetane Number of Fuel |
|---|---|---|
| DIMETHYL OXALATE | 1.0 | 0.0 |
| DI-T-BUTYL OXALATE | 1.0 | 1.1 |
| DIETHYL OXALATE | 1.0 | 1.1 |
| DIBUTYL OXALATE | 1.0 | 1.9 |

These results indicate that the addition of 1 weight percent of an oxalate to a No. 2 diesel fuel, with the exception of dimethyl oxalate, increased the fuel cetane number by a minimum of 1.1 cetane numbers. It is not entirely clear why dimethyl oxalate is not useful as a cetane improver. However, it is postulated that there is little or no production of organic radicals to initiate combustion due to the high stability of the methyl radical compared to other alkyl radicals.

Now looking again at the organic compound formula

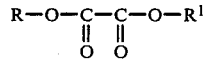

it appears that the longer the chain of the organic radicals (the $R/R^1$ groups) the more effective the oxalate is in improving the cetane number of the liquid fuel composition. Also, the more substituted or branched the organic radical group, the less effective the oxalate is as a cetane improver for liquid hydrocarbon fuels.

There is one important restriction with respect to the organic radical groups in the oxalate molecule. This restriction relates to the solubility of the resultant oxalate in the liquid hydrocarbon fuel. The solubility of the oxalate can be improved, if desired, through the use of co-solvents. Examples of typical co-solvents are alcohols and other oxygenates, naphtha and other petroleum hydrocarbons outside the middle distillate range. Such co-solvents can be naturally occurring or synthetic. The effect of the addition of alcohol to diesel fuels is to decrease the cetane number.

The liquid hydrocarbon fuel compositions of this invention may contain, in addition to the described oxalates, other additives to improve the fuels in one or more respects. For example, the fuel compositions of this invention may also contain antioxidants, antifoam agents and other ignition quality or combustion improvement agents.

Although particular embodiments of the invention have been described, it will be understood that the invention is not limited thereto, since modifications may be made which will become apparent to those skilled in the art.

What is claimed is:

1. A composition comprising:

a liquid hydrocarbon fuel boiling between about 300° and about 700° F.; and, dissolved therein, a sufficient amount of at least one organic compound so as to increase the cetane number of the hydrocarbon fuel, wherein said organic compound is of the formula:

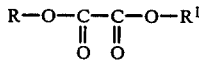

wherein R and $R^1$ are the same or different organic radicals, provided that R and $R^1$ are not both methyl groups and neither contains more than 50 carbon atoms.

2. The composition of claim 1 wherein the organic compound is present in a concentration from about 0.1 to about 10 weight percent of the composition.

3. The composition of claim 1 wherein the organic compound is present in a concentration from about 0.1 to about 5 weight percent of the composition.

4. The composition of claim 1 wherein the organic compound is present in a concentration from about 1 to about weight percent of the composition.

5. The composition of claim 1 wherein the liquid hydrocarbon fuel is a petroleum middle distillate fuel.

6. The composition of claim 1 wherein the liquid hydrocarbon fuel is diesel fuel.

7. A composition comprising:

a liquid hydrocarbon fuel boiling in the range of about 300° to about 700° F.; and, dissolved therein, a sufficient amount of at least one organic compound so as to increase the cetane number of the hydrocarbon fuel, wherein said organic compound is of the formula:

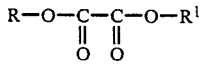

wherein R and $R^1$ are the same or different alkyl radicals with at least two carbon atoms each but no more than 50 carbon atoms each.

8. The composition of claim 7 wherein the organic compound is present in a concentration from about 0.1 to about 10 weight percent of the composition.

9. The composition of claim 7 wherein the organic compound is present in a concentration from about 0.1 to about 5 weight percent of the composition.

10. The composition of claim 7 wherein the organic compound is present in a concentration from about 1 to about 5 weight percent of the composition.

11. The composition of claim 8 wherein the liquid hydrocarbon fuel is a petroleum middle distillate fuel.

12. The composition of claim 9 wherein the liquid hydrocarbon fuel is a petroleum middle distillate fuel.

13. The composition of claim 10 wherein the liquid hydrocarbon fuel is a petroleum middle distllate fuel.

14. The composition of claim 8 wherein the hydrocarbon fuel is diesel fuel.

15. The composition of claim 7 wherein the hydrocarbon fuel is diesel fuel.

16. The composition of claim 10 wherein the hydrocarbon fuel is diesel fuel.

17. A composition comprising:

a liquid hydrocarbon fuel boiling in teh range of about 300° to about 700° F.; and, dissolved therein, a sufficient amount of at least one organic compound so as to increase the cetane number of the hydrocarbon fuel, wherein said organic compound is of the formula:

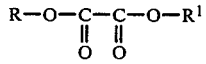

wherein R and $R^1$ are the same alkyl radicals with at least two but no more than 50 carbon atoms each.

18. The composition of claim 17 wherein the organic compound is present in a concentration from about 0.1 to about 10 weight percent of the composition.

19. The composition of claim 17 wherein the organic compound is present in a concentration from about 0.1 to about 5 weight percent of the composition.

20. The composition of claim 17 wherein the organic compound is present in a concentration from about 1 to about weight percent of the composition.

21. The composition of claim 18 wherein the liquid hydrocarbon fuel is a petroleum middle distillate fuel.

22. The composition of claim 19 wherein the liquid hydrocarbon fuel is a petroleum middle distillate fuel.

23. The composition of claim 20 wherein the liquid hydrocarbon fuel is a petroleum middle distillate fuel.

24. The composition of claim 18 wherein the hydrocarbon fuel is diesel fuel.

25. The composition of claim 17 wherein the hydrocarbon fuel is diesel fuel.

26. The composition of claim 20 wherein the hydrocarbon fuel is diesel fuel.

27. A composition comprising:

a liquid diesel fuel; and, dissolved therein, a sufficient amount of at least one organic compound so as to increase the cetane number of the hydrocarbon fuel, wherein said organic compound is selected from the group consisting of di-t-butyl oxalate, diethyl oxalate, and dibutyl oxalate.

28. The composition of claim 27 wherein the organic compound is present in a concentration from about 0.1 to about 10 weight percent of the composition.

29. The composition of claim 27 wherein the organic compound is present in a concentration from about 0.1 to about 5 weight percent of the composition.

30. The composition of claim 27 wherein the organic compound is present in a concentration from about 1 to about 5 weight percent of the composition.

31. The composition of claim 1 wherein R and $R^1$ are selected from the group consisting of alkyl, alkenyl, cycloalkenyl, aryl, alkylaryl, arylalkyl, alkenylaryl, and arylalkenyl radicals.

32. The composition of claim 6 wherein R and $R^1$ are selected from the group consisting of alkyl, alkenyl, cycloalkenyl, aryl, alkylaryl, arylalkyl, alkenylaryl, and arylalkenyl radicals.

33. The composition of claim 3 wherein R and $R^1$ are selected from the group consisting of alkyl, alkenyl, cycloalkenyl, aryl, alkylaryl, arylalkyl, alkenylaryl, and arylalkenyl radicals.

34. The composition of claim 33 wherein said fuel is diesel fuel.

35. The composition of claim 1 wherein R and $R^1$ each contains no more than 20 carbon atoms.

36. The composition of claim 6 wherein R and $R^1$ each contains no more than 20 carbon atoms.

37. The composition of claim 34 wherein R and $R^1$ each contains no more than 20 carbon atoms.

38. The composition of claim 7 wherein R and $R^1$ each contains no more than 20 carbon atoms.

39. The composition of claim 15 wherein R and $R^1$ each contains no more than 20 carbon atoms.

40. The composition of claim 16 wherein R and $R^1$ each contains no more than 20 carbom atoms.

41. The composition of claim 17 wherein R and $R^1$ each contains no more than 20 carbon atoms.

42. The composition of claim 25 wherein R and $R^1$ each contains no more than 20 carbon atoms.

43. The composition of claim 26 wherein R and $R^1$ each contains no more than 20 carbon atoms.

44. The composition of claim 7 wherein R and $R^1$ are straight chain alkyl groups.

45. The composition of claim 15 wherein R and $R^1$ are straight chain alkyl groups.

46. The composition of claim 16 wherein R and $R^1$ are straight chain alkyl groups.

47. The composition of claim 17 wherein R and $R^1$ are straight chain alkyl groups.

48. The composition of claim 25 wherein R and $R^1$ are straight chain alkyl groups.

49. The composition of claim 26 wherein R and $R^1$ are straight chain alkyl groups.

50. The composition of claim 43 wherein R and $R^1$ are straight chain alkyl groups.

51. The composition of claim 42 wherein R and $R^1$ are straight chain alkyl groups.

52. The composition of claim 41 wherein R and $R^1$ are straight chain alkyl groups.

53. The composition of claim 40 wherein R and $R^1$ are straight chain alkyl groups.

54. The composition of claim 39 wherein R and $R^1$ are straight chain alkyl groups.

55. The composition of claim 38 wherein R and $R^1$ are straight chain alkyl groups.

* * * * *

UNITED STATES PATENT AND TRADEMARK OFFICE

CERTIFICATE OF CORRECTION

PATENT NO. : 4,740,215

DATED : April 26, 1988

INVENTOR(S) : Diane M. Dillon and Peter J. Jessup

It is certified that error appears in the above-identified patent and that said Letters Patent is hereby corrected as shown below:

In column 5, line 49, after "about" add --5--.

In column 6, line 23, change "teh" to --the--.

In column 6, line 46, after "about" add --5--.

Signed and Sealed this

Eighteenth Day of October, 1988

*Attest:*

DONALD J. QUIGG

*Attesting Officer*

*Commissioner of Patents and Trademarks*